United States Patent [19]

Dola

[11] 4,342,888

[45] Aug. 3, 1982

[54] PRESSURE SWITCH WITH CONDUCTIVE HOUSING

[75] Inventor: Frank P. Dola, Port Richey, Fla.

[73] Assignee: AMP Incorporated, Harrisburg, Pa.

[21] Appl. No.: 214,901

[22] Filed: Dec. 10, 1980

[51] Int. Cl.[3] ..... H01H 35/34

[52] U.S. Cl. ..... 200/83 R; 200/246; 200/284

[58] Field of Search ..... 200/83 R, 83 B, 83 N, 200/246, 275, 283, 284, 302, 81 R

[56] References Cited

U.S. PATENT DOCUMENTS

| | | | |
|---|---|---|---|
| 3,049,603 | 8/1962 | Flatt | 200/83 R |
| 3,302,269 | 2/1967 | Cooper et al. | 29/155.5 |
| 3,538,275 | 11/1970 | Greene | 200/83 R |
| 3,555,220 | 1/1971 | Wood | 200/83 |
| 3,581,034 | 5/1971 | Schupp et al. | 200/83 |
| 4,145,588 | 3/1979 | Orcutt | 200/83 P |

*Primary Examiner*—Gerald P. Tolin
*Attorney, Agent, or Firm*—F. Brice Faller

[57] ABSTRACT

A switch responsive to changes in fluid pressure includes a conductive body member with a passage therethrough and flexible diaphragm sealingly mounted thereon. One surface of the diaphragm is in contact with the fluid and the other surface has a deformable protrusion which bears against a resilient contact member causing it to break contact with the body member when fluid attains a sufficient pressure. The contact member has a spade terminal which is mounted through a cap fixed to the end of the passage. Only five parts are utilized. An alternative normally open switch is disclosed.

6 Claims, 6 Drawing Figures

PRESSURE SWITCH WITH CONDUCTIVE HOUSING

BACKGROUND OF THE INVENTION

The present invention relates to a pressure responsive electric switch incorporating a diaphragm, and particularly to a plug type switch adapted for use in a circuit for an oil pressure warning light.

Switches of the type dscribed herein employ a diaphragm which separates the electrical contact surfaces from the fluid whose pressure is being sensed. These switches were developed in response to a need for a switch where the contact surfaces would not be contaminated by the fluid, which would adversely affect the switching. Most such switches in the prior art included several contact members in addition to a helical spring. See, e.g., U.S. Pat. No. 3,319,024. A simplification over most prior art is described in U.S. Pat. No. 3,555,220, which employs two stamped and formed sheet metal parts as contacts, one of which is stationary and the other resiliently movable to make or break contact with the stationary contact in response to movement by the diaphragm. This represents a savings in manufacturing costs due to the number and simplicity of parts, and likewise reduces the probability of failure.

The instant invention is simplest yet insofar as it employs a single stamped and formed sheet metal contact member resiliently movable to make or break contact with a conductive body member in response to movement by the diaphragm. The contact member is a strip formed with a spade terminal at one end which is inserted through a cap fixed to a conductive body member and a spring portion with a free end arranged in proximity to a contact point on the body member. The spring portion is acted on by a protrusion on the diaphragm mounted adjacent thereto on a shoulder in a passage through the body member. Over pressure protection is provided to prevent changing calibration of the spring portion.

It is thus an object of the present invention to provide a pressure switch with a minimum of parts, which are simple and economical to manufacture.

This and other objects achieved by the present invention will be apparent on considering the drawings and description which follow.

DETAILED DESCRIPTION OF THE PREFERRED EMBODIMENT

Figure 1:
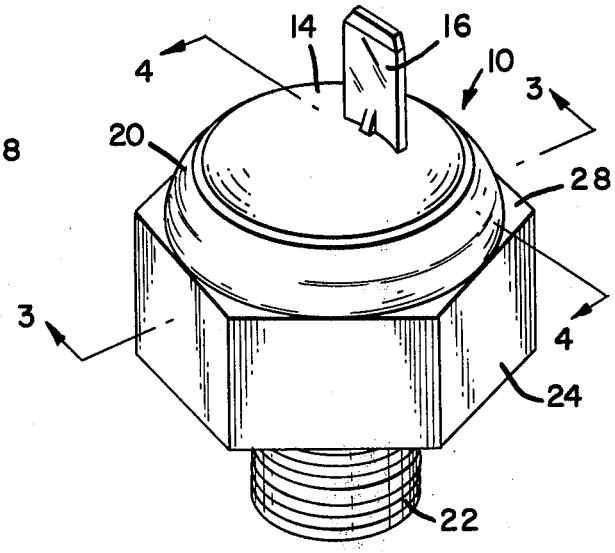
FIG. 1 is a perspective of the assembled switch.

FIG. 1 depicts an assembled pressure switch 10 ready for installation in a threaded bore which communicates with a fluid medium whose pressure is sensed. Salient features are a conductive body member 12 and cap 14 which is retained by flange 20. A spade terminal 16 protruding from the cap provides for electrical connection with a standard clip. The body member 12 has a threaded portion 22 and a hex portion 24 so that a wrench may be used to thread the switch 10 into the threaded bore.

Figure 2:
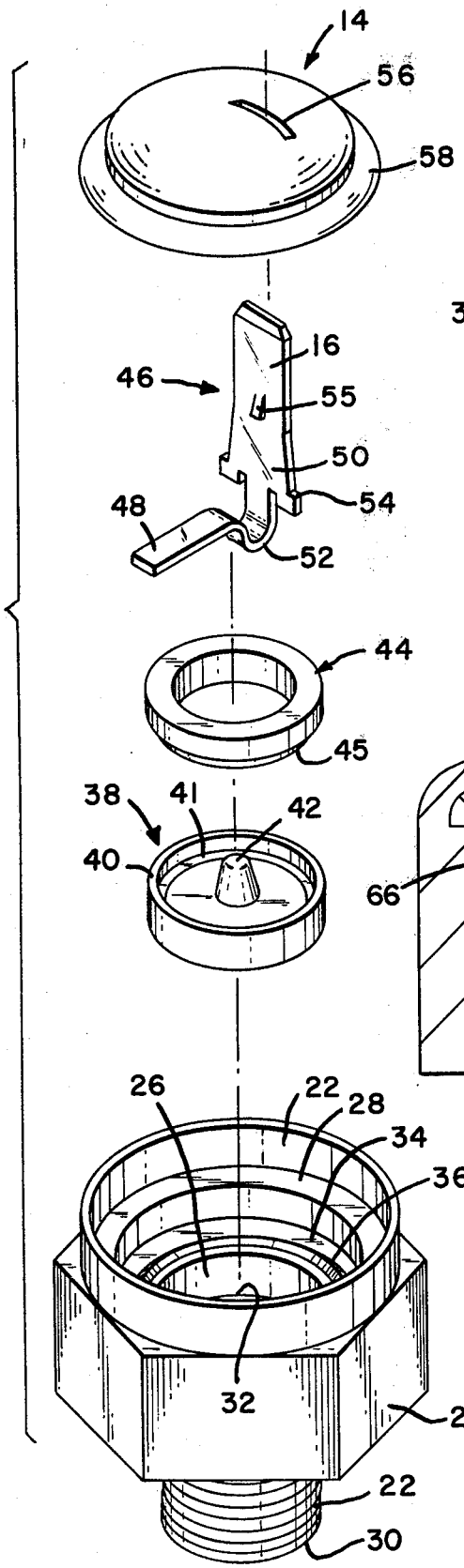
FIG. 2 is an exploded perspective of the switch components.

FIG. 2 is an exploded perspective of the component prior to assembly. Body member 12, preferably cast zinc, has a signal end 28, a sensing end 30, and a passage 26 therethrough between the ends. The passage 26 has therein a first annular shoulder 32 and a second annular shoulder 34 with an annular ridge 36 thereon which provides a contact surface. The flange 20 on signal end 28 is shown in its undeformed state. Round diaphragm 38 is flexible and has an outer lip 40 about its perimeter which is faced on the inside by an annular channel 41. The diaphragm is of deformable material, preferably silicone rubber, and has an integral protrusion 42 in the center. Seal 44, preferably of nylon, is ring shaped and has an annular lip 45 which is profiled to fit in channel 41 of the diaphragm 38. Stamped metal contact member 46 has a spring portion 48 which is attached to signal portion 50 at bend 52. The signal portion 50 has shoulders 54 at one end thereof and a spade terminal 16 at the other end with a lance 55 struck therefrom. Cap 14, preferably nylon, has an aperture 56 therethrough which is profiled to receive the spade section 16 of the contact member 46. The cap 14 is round and has a groove 58 about its periphery.

To assemble the switch 10, the diaphragm 28 is set against first shoulder 32 in passage 26 of body member 12 such that the lip 40 and protrusion 42 face the signal end 28 of the body member. The nylon seal 44 is then set on the diaphragm 38 such that the inner lip 45 sets in the channel 41 of the diaphragm. The contact member 46 is assembled to the cap 14 by inserting the spade terminal 16 through the aperture 56 until the lance 55 snaps over the surface of the cap adjacent to the aperture 56. The shoulders 54 then abut the opposite surface of the cap and the signal portion 50 of the contact member is thus fixed with respect to the cap. The cap 14 with contact member 46 assembled thereto is then set inside flange 20 against the signal end of the conductor, and the flange 20 is deformed radially inwardly by a die (not shown) to retain the cap to the body member as shown in FIG. 1.

Figure 3:
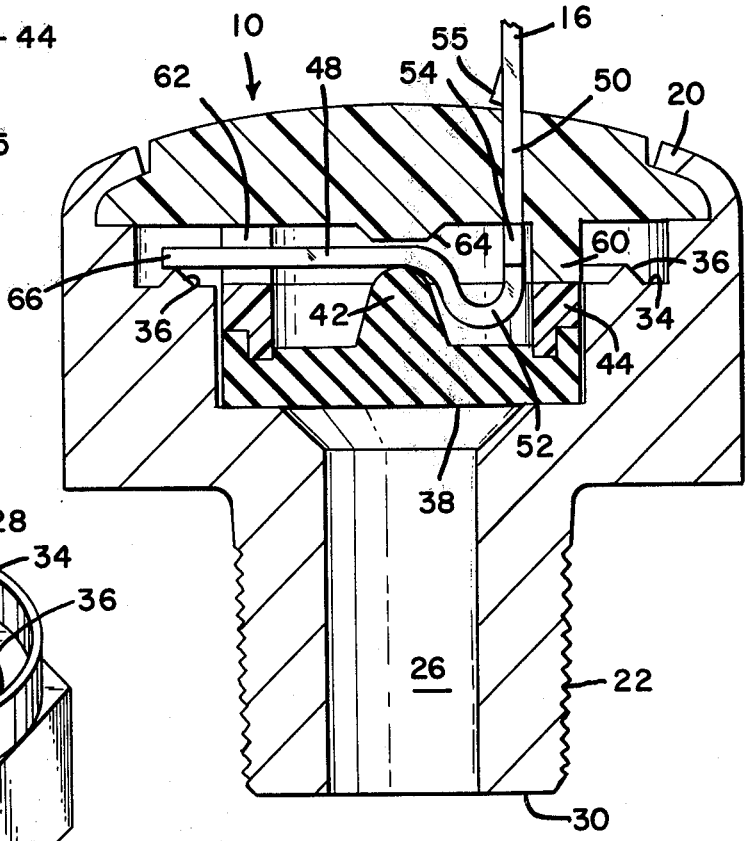
FIG. 3 is a cross section of the assembled switch taken along line 3—3 of FIG. 1.

FIG. 3 is a cross section of the assembled switch 10 in the normally closed position. Note that the spring portion 48 of the contact member 46 touches annular ridge 36 at free end 66. This completes a circuit between spade terminal 16 and the body member 12, and would generally be wired to an indicator light and a current source via a wire attached to the spade terminal 16. Thus, if the body 12 is grounded, as it would be threaded into an engine block, the light would be on in the configuration shown in FIG. 3. Note that contact member 46 is firmly fixed to cap 14 and the cap is secured to the body 12 by flange 20; the spring portion 48 is pre-loaded at bend 52 to bear resiliently against ridge 36 unless borne against by protrusion 42 of the diaphragm 38. The diaphragm 38 and seal 44 are held in place against the first shoulder 32 by a semicircular ridge 60 on the cap; the ridge 60 forms an almost complete ring which bears against seal 44, but leaves a gap 62 to freely accommodate the spring portion 50 of the contact member.

Figure 4:
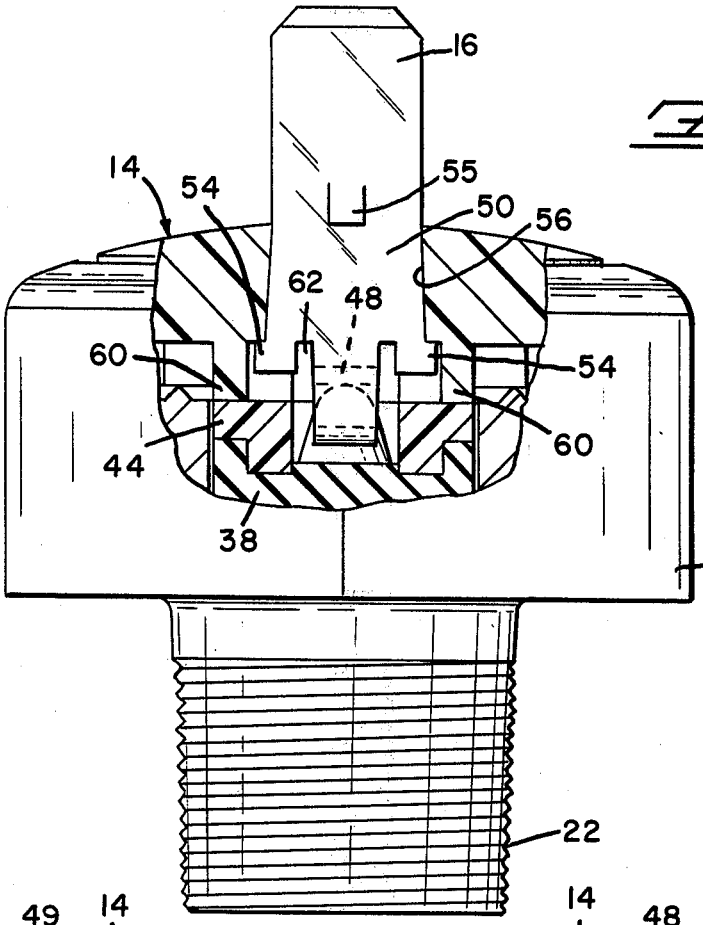
FIG. 4 is a cutaway cross section taken along line 4—4 of FIG. 1.

FIG. 4 is another cross section of the assembled switch 10 taken 90 degrees from FIG. 3, showing additional detail of the retention of signal portion 50 in aperture 56.

Figure 5:
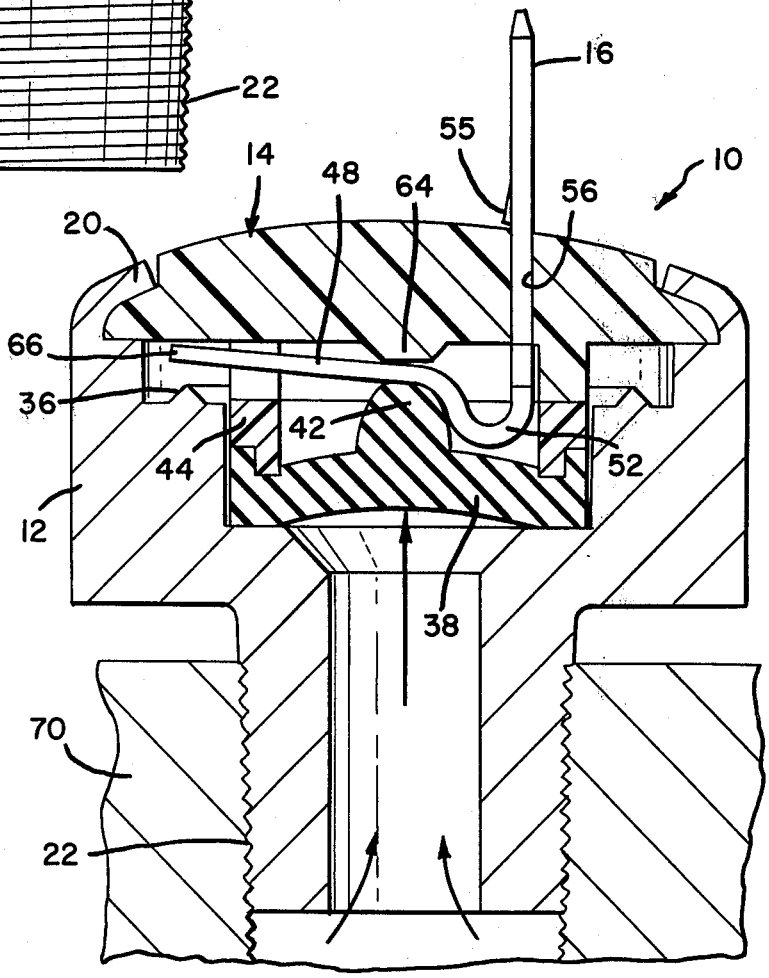
FIG. 5 is a cross section similar to FIG. 3, of the switch as installed in an engine block and acted upon by fluid.

FIG. 5 details the switch as installed in a threaded bore in an engine block 70. Oil under pressure acts on diaphragm 38 and deflects it, causing the protrusion 42 to bear against the spring portion 48 of contact member 46, which breaks contact between the free end 66 of the spring portion and the annular ridge 36 in the plug body. This interrupts the circuit and causes the indicator light to go out, thus signaling the driver that he has oil pressure. The unit would generally be designed for contact to be broken in response to fluid pressures on the order of 6–9 psi; the protrusion 42 first contacts the spring portion 48 and bears against it until the force is sufficient to break contact. Increased pressure and resulting increased force on the contact member causes the spring portion 48 to bear against stop 64 on the cap, which serves as over pressure protection. This avoids calibration changes in the contact member which would affect its pressure response. Further increased pressure merely causes the protrusion to deform slightly as it bears against the contact member 46.

The foregoing description is directed to a normally closed plug type pressure switch intended for use as an oil pressure sensor in an automobile engine, but it should be realized that the principles involved apply to construction of a simple switch responsive to pressure change in any fluid medium.

Figure 6:
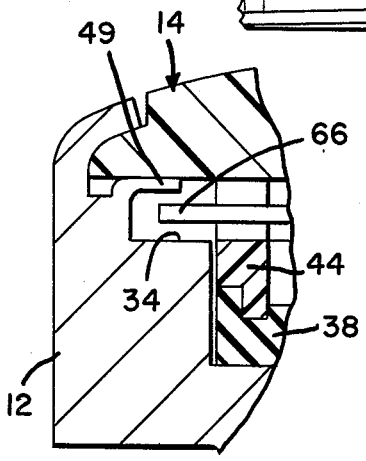
FIG. 6 is a fragmentary cross section of an alternative normally open embodiment.

FIG. 6 is a fragmentary cross section of a normally open embodiment in which like reference numerals are used for like elements. Here a third annular shoulder 49 is formed into the body member 12 opposite second annular shoulder 34 so that free end 66 bears against shoulder 49 when diaphragm 38 is subjected to sufficient fluid pressure.

What is claimed is:

1. A fluid pressure switch of the type having a sensing end which contacts a fluid medium and a signal end where an electrical conductor is attached comprises:

an electrically conductive body member having a sensing end, a signal end, and a passage therethrough between said ends, a flexible dielectric diaphragm occluding said passage between said ends, a dielectric cap fit over said passage at said signal end of said body member, an electrically conductive contact member having a signal portion and a spring portion, said signal portion being carried by said cap, said spring portion being disposed adjacent to said diaphragm and having a bend where it attaches to said signal portion and a free end disposed for engagement with a contact surface on said body member, said free end being resiliently movable with respect to said contact surface in response to movement of said flexible diaphragm against said spring portion.

2. The switch of claim 1 wherein said switch is a normally closed switch, said contact surface being on a shoulder in said passage which faces said signal end, said free end of said spring portion being in contact with said contact surface unless said diaphragm bears against said spring portion with sufficient force to break contact between the free end of the spring portion and the contact surface.

3. A pressure switch as in claim 1 wherein said cap has an aperture therethrough and said contact member is stamped and formed metal, said signal portion having a shoulder thereon which bears against the cap adjacent to said aperture and a flat spade portion which protrudes from said aperture in said cap, said spade portion having a lance struck therein which bears against said cap, whereby said contact member is fixed to said cap by said shoulder and said lance.

4. A pressure switch as in claim 1 wherein said diaphragm has a protrusion thereon positioned to bear against said spring portion of said contact member at a point between said free end and said bend, said protrusion being deformable.

5. A pressure switch as in claim 2 wherein said switch has over pressure protection in the form of a stop on said cap, said spring portion bearing against said stop when said diaphragm bears against said spring portion with a force in excess of that necessary to break contact between the free end and the contact surface.

6. An oil pressure switch of the type having a sensing end which contacts a fluid medium and a signal end where an electrical conductor is attached comprises:

an electrically conductive body member having a sensing end, a signal end, and a passage therethrough between said ends, said passage having a first annular shoulder therein facing said signal end, said passage having a second annular shoulder therein facing said signal end, said second shoulder lying between said first shoulder and said signal end, a flexible dielectric diaphragm seated about its perimeter against said first shoulder, a dielectric cap fit over said passage at said signal end of said body member, said body member having retaining means for fixing said cap thereto, said cap having an aperture therein, an electrically conductive contact member having a spring portion and a signal portion, said spring portion lying at a substantially right angle with respect to said signal portion, said signal portion passing through said aperture in said cap and being fixed with respect to said cap, said spring portion having a fixed end where it attaches to said signal portion and a free end which bears against said second shoulder unless said diaphragm bears against said spring portion with sufficient force to break contact between the free end and the second shoulder.

* * * * *